US009073088B2

(12) United States Patent
Walton et al.

(10) Patent No.: US 9,073,088 B2
(45) Date of Patent: Jul. 7, 2015

(54) CENTRIFUGAL SIZE-SEPARATION SIEVE FOR GRANULAR MATERIALS

(76) Inventors: Otis Walton, Livermore, CA (US); Christopher Dreyer, Lakewood, CO (US); Edward Riedel, Boulder, CO (US)

( * ) Notice: Subject to any disclaimer, the term of this patent is extended or adjusted under 35 U.S.C. 154(b) by 0 days.

(21) Appl. No.: 13/448,480

(22) Filed: Apr. 17, 2012

(65) Prior Publication Data

US 2013/0270158 A1 Oct. 17, 2013

(51) Int. Cl.

| | |
|---|---|
| ***B07B 1/24*** | (2006.01) |
| ***B07B 1/22*** | (2006.01) |
| ***B07B 1/26*** | (2006.01) |

(52) U.S. Cl.

CPC ... *B07B 1/22* (2013.01); *B07B 1/24* (2013.01); *B07B 1/26* (2013.01)

(58) Field of Classification Search

CPC ..... B07B 1/22; B07B 1/24
USPC ..... 209/284–291, 293, 294, 296–299
See application file for complete search history.

(56) References Cited

U.S. PATENT DOCUMENTS

| | | | | |
|---|---|---|---|---|
| 1,596,428 | A * | 8/1926 | Greene | 209/238 |
| 2,601,924 | A * | 7/1952 | Gonder | 209/284 |
| 5,108,584 | A * | 4/1992 | Brosseuk | 209/44 |
| 6,261,417 | B1 * | 7/2001 | Iwashige | 162/261 |
| 8,091,711 | B2 * | 1/2012 | Hsiau et al. | 209/284 |
| 2010/0326892 | A1 * | 12/2010 | Hsiau et al. | 209/240 |

OTHER PUBLICATIONS

"Physics Phun!", Univeristy of Virginia, internet, retrieved Dec. 27, 2013, http://phun.physics.virginia.edu/topics/centrifugal.html.*

* cited by examiner

*Primary Examiner* — Michael McCullough
(74) *Attorney, Agent, or Firm* — Richard B. Main; Main Cafe

(57) ABSTRACT

A centrifugal sieve and method utilizes centrifugal force in rapidly-rotated cylindrical or conical screens as the primary body force contributing to size segregation. Within the centrifugal acceleration field, vibration and/or shearing flows are induced to facilitate size segregation and eventual separation of the fines from the coarse material. Inside a rotating cylindrical or conical screen, a separately-rotated screw auger blade can be used to transport material along the rotating cylinder or conical wall and to induce shearing in the material.

2 Claims, 7 Drawing Sheets

CENTRIFUGAL SIZE-SEPARATION SIEVE FOR GRANULAR MATERIALS

FEDERALLY SPONSORED RESEARCH AND DEVELOPMENT

This invention was made with Government support under contract NNX11CE32P awarded by NASA. The Government has certain rights in this invention.

FIELD OF THE INVENTION

The present invention relates generally to mechanical size separation of granular solids, and more particularly to the use of sieving screens to separate a material with a wide size distribution into various size-fractions, and most particularly to the utilization of centrifugal force acting inside rapidly rotating cylindrical or conical screens to facilitate such size separation.

BACKGROUND OF THE INVENTION

Dry granular solids are notorious for size-segregation whenever they are poured from one container to another. Any time dry granular solids undergo shear flow in a gravity field (or when a body force has a component perpendicular to the direction of shear), large particles tend to rise to the top and fines tend to sift to the bottom. On a particle-scale, two major mechanisms contribute to this size segregation. One is a dynamic-sieve phenomenon whereby the more-mobile fine particles can move into openings created below them faster that large particles can, and thus tend to 'migrate' toward the bottom of the vibrated bed. As a consequence of this, under certain vertical vibration conditions, large particles rise to the top of a vibrated packed granular bed (i.e., the so-called 'Brazil nut' problem described by Rosato et al, 1987). The second particle-scale mechanism, contributing to size-segregation in shearing flows, comes from larger particles rotating and 'rolling' up-and-over smaller particles in the shearing flow. As Haff and Werner (1986) describe, in simulations of shear motion of a granular bed, the effective grain-grain friction coefficient $\mu$ is a critical parameter in this kind of sorting process, since if $\mu$ is too small, a large spherical grain cannot get sufficient purchase to roll without slipping. Irregularly shaped particles invariably rotate whenever the granular bed shears (the average rotation rate of particles in a shearing flow is proportional to the local shear-rate in the bed). The dynamic-sieve mechanism acts during shearing flows, but it also operates even in non-shearing situations. Vibratory-screen sifters make use of the natural tendencies for granular solids to have the fines migrate to the bottom in vibratory and/or shearing flow. When a container is vibrated or oscillated, the fine-fraction will migrate to the bottom, and by placing a fine screen on the bottom surface, gravity and contact forces from the granular bed above push the fines through the screen, leaving the coarse fraction on top of the screen. Under reduced gravity conditions, such as during planned in situ resource recovery operations on the moon, however, vibratory-screen sifters do not function well for separation of small (i.e., sub 0.15 mm range) particles, as was recently demonstrated in reduced-gravity flights (Ramé et al, 2010).

Trommel Screens (e.g., slowly rotated, nearly horizontal, cylindrical screens, partially filled with granular material) have been used for centuries for screening or size-separation of granular solids. They function very well terrestrially for segregating out large (>1 cm) particulates. They are used extensively in the mining and mineral industry to remove oversize rocks from feed stock before processing steps. Most Trommel screens are designed for dry granular materials; however, there are liquid-solid-slurry versions of Trommel screens that are used to separate out denser ores from lighter material. For dry materials, as the particle size gets smaller or cohesive materials are involved, Trommel screens become less effective, and other configurations are often utilized. The rotation rate of a Trammel screen cannot be increased beyond the 'critical' value where centrifuging of the solids onto the outer wall begins, because centrifuging stops the shearing flow in the usual Trommel Screen configuration.

For separations involving smaller particle sizes (down to 0.1 mm or so) one variety of small commercial size-separation units, which are known as 'centrifugal-sifters' or 'centrifugal-screens,' utilize relatively rapidly rotating paddle-like blades inside of stationary cylindrical screens to separate fines from coarse dry solids. Companies such as Russel Finex Ltd., UK; Kason Corporation, Millburn, N.J.; S. Howes, Inc., NY; or Jiangyin Wanlu Machine Mfg., Jaingsu, China, all sell 'centrifugal'-sifters or screens which work on nearly the same principle. These 'paddle wheel' sifters have a rapidly rotating, slightly-spiral paddle-wheel, or set of blades which shear material over a stationary screen. The rotation rate of the paddle blades is high enough that centrifugal force moves the fines to the stationary outer cylindrical screen. The oversize material is retained inside the mesh screen and moved towards the oversize outlet (at the opposite end of the cylindrical screen from the inlet feed) because of the slight spiral angle of the paddle blades, and is ejected from the machine. These paddle-wheel centrifugal sifters are effective; however, part of their effectiveness may come from the effects of entrained air circulated by the paddle blades. Also, they may have inherent wear problems when utilized with highly abrasive materials. Since some of their effectiveness may come from air entrainment, the effectiveness of such sifters under vacuum conditions, as might be encountered in space-mission applications, has not been established.

Most rotating-screen centrifugal systems involving solids are two-phase fluid-solid systems. The most common centrifugal separators for solids do not have rotating mechanical parts, but instead have stationary mechanical hardware with flowing two-phase mixtures, such as gas-solid cyclone separators or hydro-cyclones, used primarily to separate solids from gases or liquids, respectively, but can also function to select specific size particulates.

Separating liquid from solids, often referred to as de-watering, is often accomplished through the use of rapidly rotating cylindrical or conical outer screens or porous walls designed to allow the liquid to pass through, while retaining the solids inside. The most familiar example might be the spin cycle of a typical clothes washing machine, where the wash water passes through the holes in the rotating cylindrical outer wall of the wash tub and the clothes are retained inside. Rotating mechanical screen-scroll centrifuges are routinely used to dewater coal and other wet particulates. These centrifuges operate at very high rotation rates and typically have conical (10° to 30° half-angle cones) or cylindrical outer screens with screen openings ranging in size from 0.25 mm to 1 mm (these are used extensively in the coal and/or paper industries). Their primary application is liquid-solid separation—allowing liquid to pass through the outer screen wall while retaining the desired particulate product inside the screen.

These dewatering systems are often configured in continuous-flow mode with mixed liquid-solid material entering the system and separate solid and liquid streams leaving the equipment (with the solids often conveyed by a continuous helical screw). In a batch-mode operation, large industrial centrifuges are also commonly used in water and wastewater treatment to dry sludges (creating a dry cake-bed, which is periodically removed).

Dewatering centrifuges utilize both cylindrical and conical screens, and can be oriented in horizontal or vertical configurations, depending on the design and application. In continuous mode operation the cylindrical screen centrifuges utilize either rotating helical (screw) blades to move the dried solid cake material to the exit region, or a traveling scraper blade. Conical screen centrifuges can use a straight 'peeler' blade, a tapered helical scroll blade, or they can employ vibrations to convey the drying cake material from the small radius to large radius portion of the conical screen (and the exit). Pre-acceleration of the slurry, up to centrifugal wall speeds, before entering the screen section has been shown to increase screen life significantly (Leung, 1998).

Vibrating conveyance in conical dewatering centrifuges operates by having a high frequency excitation force which produces either axial or circumferential vibration, which in turn, partially 'fluidizes' the material on the wall, lowering its effective wall friction and allowing it to move axially toward the larger radius region (Leung, 1998). The half-angle of the conical screen in dewatering centrifuges is usually between 18° and 25°; however, screen suppliers typically stock conical screens for centrifuges with half-angles ranging from 10° to 30°. Recent reviews of various centrifugal options for dewatering solids, describe systems similar to those in Leung's 1998 handbook (Sutherland, 2005; Records and Sutherland, 2002) and point out that most continuous centrifuging processes involving solids utilize centrifuging conical screens, wherein the solids move from the small to the large end of the screen, either by vibration or with mechanical assistance (i.e., utilizing stationary or moving blades, or tapered screws). There appear to be no commercial dry solids separators based on rotating screen centrifuges; although the screen bowl centrifuges used to dry coal slurries have been studied as potential size-separator devices (Mohanty, et al, 2008); however, the discussions of such designs in the literature were still describing systems which utilize particles in a slurry, with water.

SUMMARY OF THE INVENTION

Rapidly rotating cylindrical or conical screens are utilized to achieve size separation or sieving of granular feedstock. These centrifugal sieves take advantage of the centrifugal force acting on a granular material inside of each screen as the primary body force acting on the material pushing it against the rotating screen. Size separation is achieved independent of gravity level. These centrifugal sieves can utilize either vibration or induced shearing flow to enhance separation, especially when fine particulates are being separated by size. The sieves can be utilized in a batch mode to obtain multiple size fractions more rapidly than by using conventional vibration-only sieves. Continuous-flow mode units can readily be scaled to any desired mass flow rate, and can function in true micro-gravity (as occurs on the surfaces of extra-terrestrial solar-system bodies such as asteroids, or moons of Mars), with no gravity-flow components in the feedstock supply line, or in the fines or coarse-fraction exit streams. For space mission applications, such size segregation sieves could be utilized to achieve a degree of mineral beneficiation before regolith processing operations. Size segregation before volatile recovery processes could be utilized to ensure efficient and robust operation of the processing equipment. Some embodiments of the centrifugal sieves of this invention can function with no internal blades or vanes, and thus, can be robust to feedstock with wide size ranges and occasional oversized particles.

An aspect of the invention is an apparatus for size separation of a granular material, having a rotating cylindrical or conical screen having an input end into which the granular material is input, the screen rotating at a speed sufficient that centrifugal force is the primary body force pushing the material against the rotating screen; and an axial flow and shearing producing mechanism coupled to the rotating screen to move the material axially along the rotating screen and to increase shearing in the material; whereby finer particles pass through the rotating screen and coarser particles pass out from an outlet end of the rotating screen. The axial flow and shearing producing mechanism may be a vibration mechanism or a rotating internal helical mechanical auger blade or screw or brush or both. One or more additional spaced concentric screens may be attached to a rotating cylindrical screen, with each circumscribing screen being finer than the adjacent inner screen.

Another aspect of the invention is a rotating cylindrical screen; an internal screw conveyor extending through the rotating cylindrical screen; a spaced concentric cylindrical housing surrounding the rotating cylindrical screen and extending beyond both ends of the screen; an input screw conveyor coupled to the input end of the interior screw conveyor; a finer particles collection housing or removing screw conveyor coupled to the housing; a finer particles moving helical auger blade or screw or brush attached to the outside of the rotating screen and rotating inside the concentric cylindrical housing for pushing finer particles which pass through the rotating screen towards the finer-particles collection housing or removing screw conveyor; and a coarser particles collection housing or removing screw conveyor coupled to the output end of the interior screw conveyor.

A further aspect of the invention is a method for size separation of a granular material, by inputting the granular material into an input end of a rotating cylindrical or conical screen; rotating the cylindrical or conical screen at a speed sufficient that centrifugal force is the primary body force pushing the material against the rotating screen; and producing an axial flow and shearing of the material in the rotating screen to move the material axially along the rotating screen and to increase shearing in the material; whereby finer particles pass through the rotating screen and coarser particles pass out from an outlet end of the rotating screen. The axial flow and shearing of the material in the rotating screen may be produced by vibrating the rotating screen, or by providing a rotating internal helical mechanical auger blade or screw or brush inside the rotating screen, or both.

BRIEF DESCRIPTION OF THE DRAWINGS

The invention will be more fully understood by reference to the following drawings which are for illustrative purposes only.

DETAILED DESCRIPTION OF THE INVENTION

Figure 1:
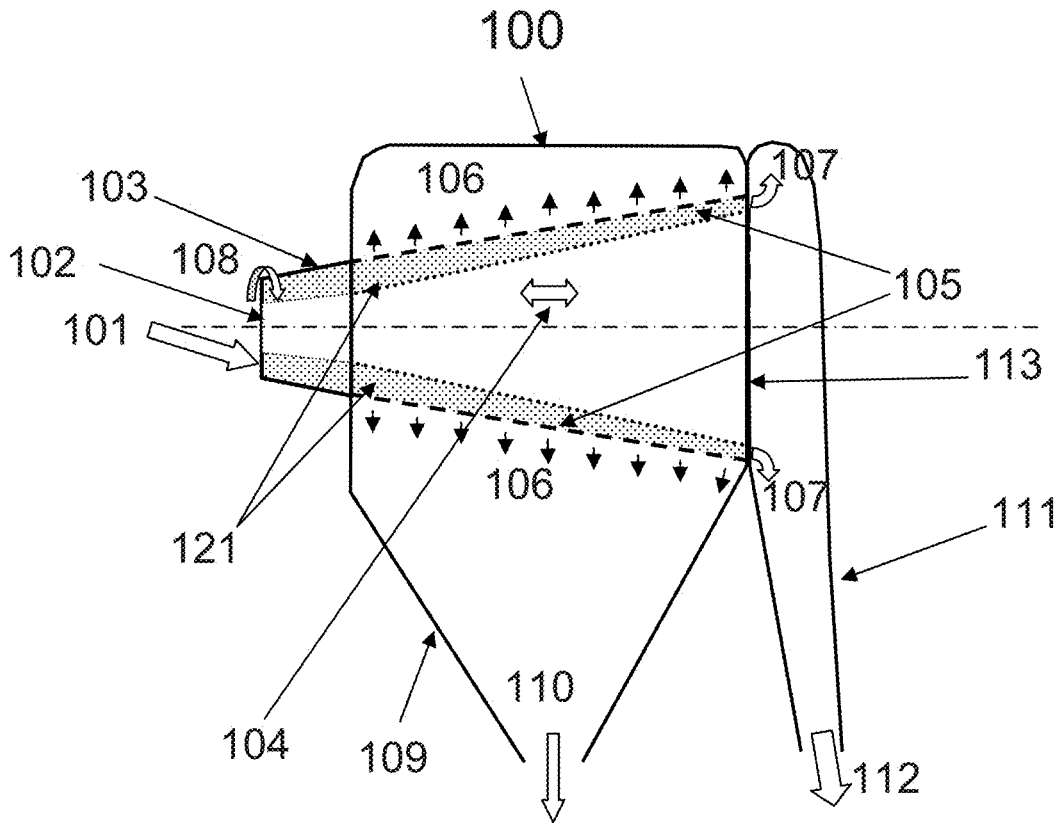
FIG. 1 is a schematic diagram of a centrifuging screen separator of the invention utilizing a rotating conical screen.

Referring more specifically to the drawings, for illustrative purposes the present invention is embodied in the apparatus and method generally shown in FIG. 1 through FIGS. 5A-C. It will be appreciated that the apparatus may vary as to configuration and as to details of the parts, and the method may vary as to its particular implementation and as to specific steps and sequence, without departing from the basic concepts as disclosed herein.

The centrifugal sieve and sieving method of the invention utilizes centrifugal force in rapidly-rotated conical or cylindrical screens as the primary body force driving size segregation. The present invention is based on a new approach for solids sieving, particularly well suited for a low gravity environment. Axial flow of solids in vibrating centrifuging conical containers can function nearly independent of gravity. Also, as long as some gravity force is present, inclined rotating cylindrical screens, with solids centrifuged on the outer wall, can have net axial flow of solids, and shearing, if they are vibrated at an appropriate amplitude and frequency so that the friction holding the material stationary on the wall is reduced enough to allow flow. Conical screen configurations will not need to have internal paddle blades shearing the material to make it pass through the screen. Thus, they would be particularly robust for feedstock with unknown quantities of oversize particles. In the centrifugal-sieves of the invention, centrifugal force, vibrations and shearing flow will push fines to and through the outer screen. The driving forces for segregation, flow and screen-passing will be nearly independent of gravity, so that the effectiveness of the sieving can be controlled by the operating parameters of the rotating screen and vibrations. In a horizontal configuration, or under microgravity conditions in any orientation, an internal mechanical blade (or screw) could induce shearing and axial displacement of the solids. These new, near-gravity-independent sieves could separate coarse regolith particles from fines under low-gravity and vacuum conditions, with minimal maintenance. The present invention uses artificial gravity, in the form of the centrifugal force inside of a rapidly rotating conical (or cylindrical) screen, to provide the primary driving force to move particles to and through the screen so that it can operate in a low gravity environment, or be applied to cohesive materials.

The invention is a centrifugal sieve and sieving method that utilizes centrifugal force in rapidly-rotated cylindrical (and/or conical) screens as the primary body force contributing to size segregation. Within the centrifugal acceleration field, vibration and/or shearing flows are induced to facilitate size segregation and eventual separation of the fines from the coarse material. One embodiment (FIG. 3) utilizes a separate screw auger blade to transport material along the rotating cylinder wall and to induce shearing in the material. This configuration could be used with or without vibration of the outer screen, since it could utilize the screw auger motion alone to induce the separation and flow of the material. A similar, but tapered, screw auger blade or brush could also be utilized inside as centrifuging conical screen (FIG. 1) in place of vibration, to achieve axial flow of the solids in the conical screen. The screw auger approach can function nearly independent of gravity (as long as the centrifugal force from the rotating screen exceeds the acceleration of gravity by a significant factor). Since this configuration has a blade or brush rubbing on the screen, however, it might have relatively high wear on the screen, and thus shorter useful-life expectancy than configurations that could shear or sieve the material without the use of such a blade or brush rubbing over the screen.

Alternative configurations (FIGS. 1 and 2) function without any internal blade, auger or brush. One such embodiment has a cylindrical rotating screen (FIG. 2) tilted downward so that a component of gravity provides the driving force to transport material axially along the cylinder. The rotation rate and tilt angle are such that material only moves along the wall if vibrations reduce the effective wall friction enough for motion to occur. Those same vibrations induce the size segregation and fines separation through the outer screen. One potential drawback of this configuration is that the same combination of tilt angle and rotation rate will probably not be optimum for both terrestrial and lunar gravity-levels. This configuration would not function under micro-gravity, since there would be no axial driving force to move material through the sieve-screen.

In another embodiment (FIG. 1), mixed-size feed stock is introduced into the small end of a (nominally horizontal) rotating conical screen, and axial (or circumferential) vibration of the conical screen lowers the effective bulk wall friction, allowing the material to flow and shear in the axial direction (toward the large open end of the cone). As the material flows and shears over the vibrating screen wall, the centrifugal force directs the fines to and through the screen, and the coarse fraction continues moving axially to the end of the cone. In addition to the vibration of the screen, the diverging cone geometry ensures that shearing occurs within the granular bed; shearing is enhanced by the wall friction which makes the outer, or bottom, portion of the flowing layer move at a lower velocity than the inner portion of the granular bed. This shearing flow increases the size segregation over what it would be from simple vibration of the bed.

All three of these (and other) embodiments are based on utilizing centrifugal force to hold material on the inner surface of a rotating (conical or cylindrical) screen. The high centrifugal force will allow the well-known mechanism of dynamic sieving, (or particle rotation within shearing flow), to induce particle size segregation and separation. The centrifuging-screen designs can provide sufficient force on fine particles near the screen to overcome interparticle cohesion and propel them through the screen openings. The separation process will not require a prevailing gravity field, nor will it depend on air flow effects. The basic concept can be scaled for any desired throughput. Thus, such sieves could be designed to operate at a scale suitable for screening samples collected on a small robotic mission to an asteroid, or for semi-permanent lunar In Situ Resource Utilization (ISRU) processing operations.

In order to achieve the desired separation of size fractions from feedstock, it is necessary to have a relatively thin flowing layer with significant shear and/or vibration so that the coarse fraction will rise all the way to the top, or conversely, so that the fine fraction will migrate all the way to the bottom, where the screen is located. A simple conical configuration of the invention achieves shearing flow throughout the process, starting with the acceleration cone near the entrance. Even at the small end of the acceleration cone, the centrifugal force from the rotation of the unit will exceed gravity by a factor of three or more. Since material entering the cone will not be traveling at the wall speed, significant sliding and shearing will occur as the material accelerates up to the local wall speed. The walls of the acceleration cone will not be made of screen (because it is more vulnerable to damage from wear than solid walls) but will have a few small nearly axial internal ridges or blades which will increase both the effective wall friction and the shearing action on the granular material as it accelerates up to the wall speed. Thus, by the time the material is up to the wall speed and enters the screen covered region, it will have already experienced significant shearing flow under a relatively high artificial gravity force. The bottom of the flowing layer will already have a high concentration of fines—this will provide appropriate material to pass through the screen and also serve to protect the screen from scrapes with the largest particles which may still be rising to the top surface of the flowing layer. As the material proceeds along the inside of the conical screen it will continue to experience shear deformation because the circumference of the cone, seen by the material, will be increasing along with its axial progression toward the large end. The cone angle will be less than the angle of repose of the granular solid so that the axial velocity of the material can be controlled by the friction-reducing vibrations, which will also serve to increase the rate of size segregation that occurs above the screen. The vibrations will also reduce the cohesion and friction resistance of the fines passing through the screen—increasing the efficiency of the separation. The change in radius from small end to large end is preferably at least a factor of three (e.g., varying from about 2.5 cm to about 7.5 cm) which means the flowing material will experience a very large shear strain, separate from the vibrations or the change in composition of the material.

As shown in FIG. 1 a centrifuging screen separator 100 utilizes a rotating conical screen 105. The screen 105 rotates as indicated by arrow 108 about a horizontal axis. (However such a design could also function with a vertical axis, with solids flowing either up or down along the inner wall of screen 105). In separator 100, mixed-size granular feed stock (material) 101 enters through the small end 102 of the conical screen 105, and is accelerated up to the angular speed of the screen 105 in a short conical accelerator section 103, which may have axially aligned radial blades to assist in accelerating the material up to the cone's rotation rate. The granular material 101 forms a relatively uniform layer 121 on the inside of the rotating cone. In a preferred embodiment, the half-angle of the cone is less than the angle-of-repose of the granular material, so that at rotation rates where the centrifugal acceleration near the wall of the cone exceeds the acceleration of gravity, the material would remain stationary against the rotating conical wall. Axial vibrations represented by arrow 104, or circumferential vibrations, reduce the effective internal friction in the granular material and allow it to flow along the inner wall of the conical screen. Alternatively, instead of vibrations, a tapered helical screw, a brush, or a blade (similar to that shown in FIG. 3 or 4 for cylindrical screens) could be used to move material axially along the conical screen wall. An alternative embodiment could have the half-angle of the cone be greater than the angle-or-repose of the granular material, in which case the material will flow along the inside of the cone without any vibrations. Configurations utilizing such a large-angle cone configuration may, however, not be as straightforward to control or optimize for different material properties, because the axial velocity of the shearing material flowing along the inner conical screen wall would not be as readily controlled by changing the operating parameters of the sieve as it would be with a narrower-angle cone. In all conical embodiments of the separator 100, as the material flows over the rotating conical screen 105, it is sheared both because the circumference of the screen is increasing, and because the friction of the outer wall makes the material near the outer wall move slower than the material near the inner free surface. Because of shearing and/or vibrations, fines migrate to the screen and the centrifugal force, vibration, and contact forces from the material above all contribute to pushing the fines through the screen 105, forming a fines-stream 106 which is collected by a surrounding shroud 109, to form an outlet stream 110 of the fine-fraction of the original mixed-size material. The coarser material 107 does not pass through the conical screen wall and exits out the large end 113 of the cone 105, where it is collected by another shroud 111 to form an outlet stream 112. Conventional mechanisms for mounting, driving, and vibrating the rotating screen are used, and will not be further described.

Figure 2:
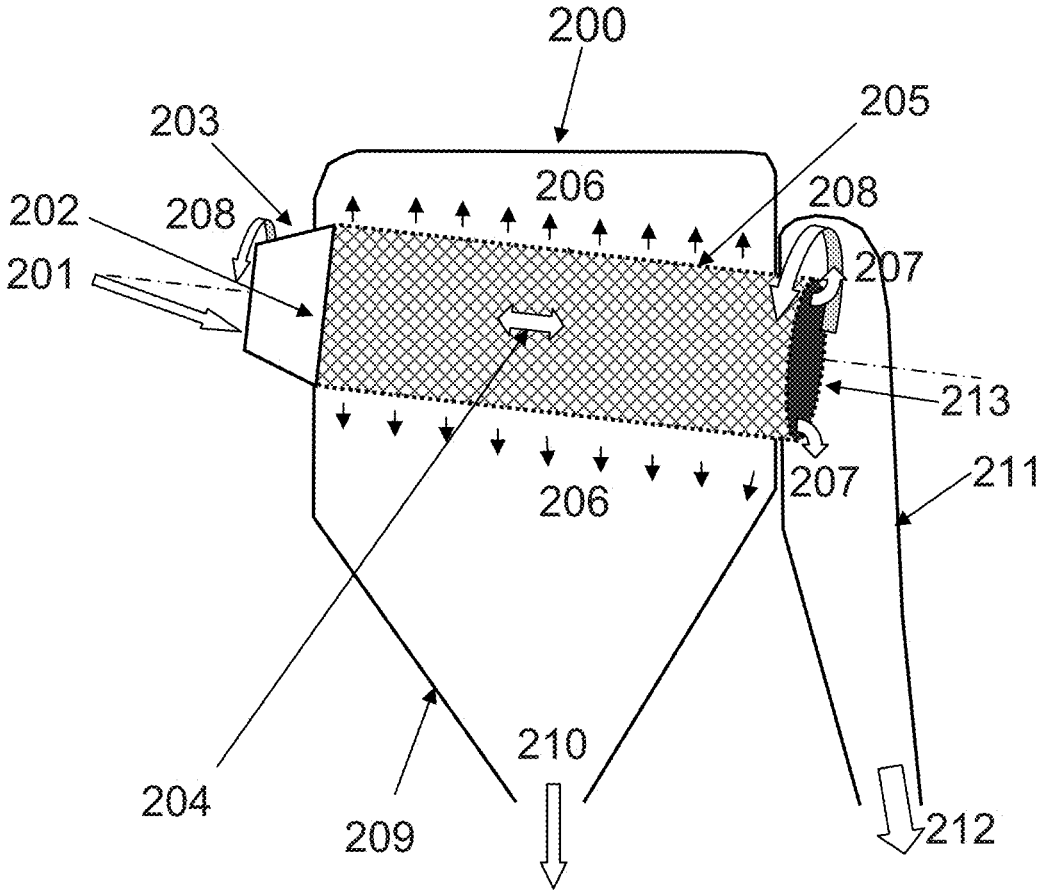
FIG. 2 is a schematic diagram of a centrifuging screen separator of the invention utilizing a rotating cylindrical screen.

As shown in FIG. 2 a centrifuging screen separator 200 utilizes a rotating cylindrical screen 205. The screen 205 rotates as indicated by arrows 208. In this case the cylinder 205 is tilted at an angle less than the angle of repose of the granular material and the mixed size material 201 enters at the high-end 202 of the cylinder 205, and can be accelerated up to the rotational speed of the cylindrical screen 205 in a conical or cylindrical accelerator section 203, which can have internal radial blades to assist in the acceleration of the feedstock. Under normal centrifuging operating conditions the material would form a relatively uniform layer around the circumference of the cylinder, but would not flow axially unless the cylinder is vibrated axially as represented by arrow 204, or circumferentially to reduce the effective internal friction of the granular material. With vibrations the material flows and shears along the rotating cylindrical screen 205, and the fines 206 pass through the screen 205. The coarse material 207 does not pass through the screen and exits at the lower end 213 of the rotating cylinder (screen) 205. As with the conical embodiment, a surrounding shroud 209 collects the fines 206 passing through the screen to form an outlet stream 210, and a shroud 211 collects the coarser material 207 passing out the distal end 213 of the cylinder to form an outlet stream 212.

Figure 3:
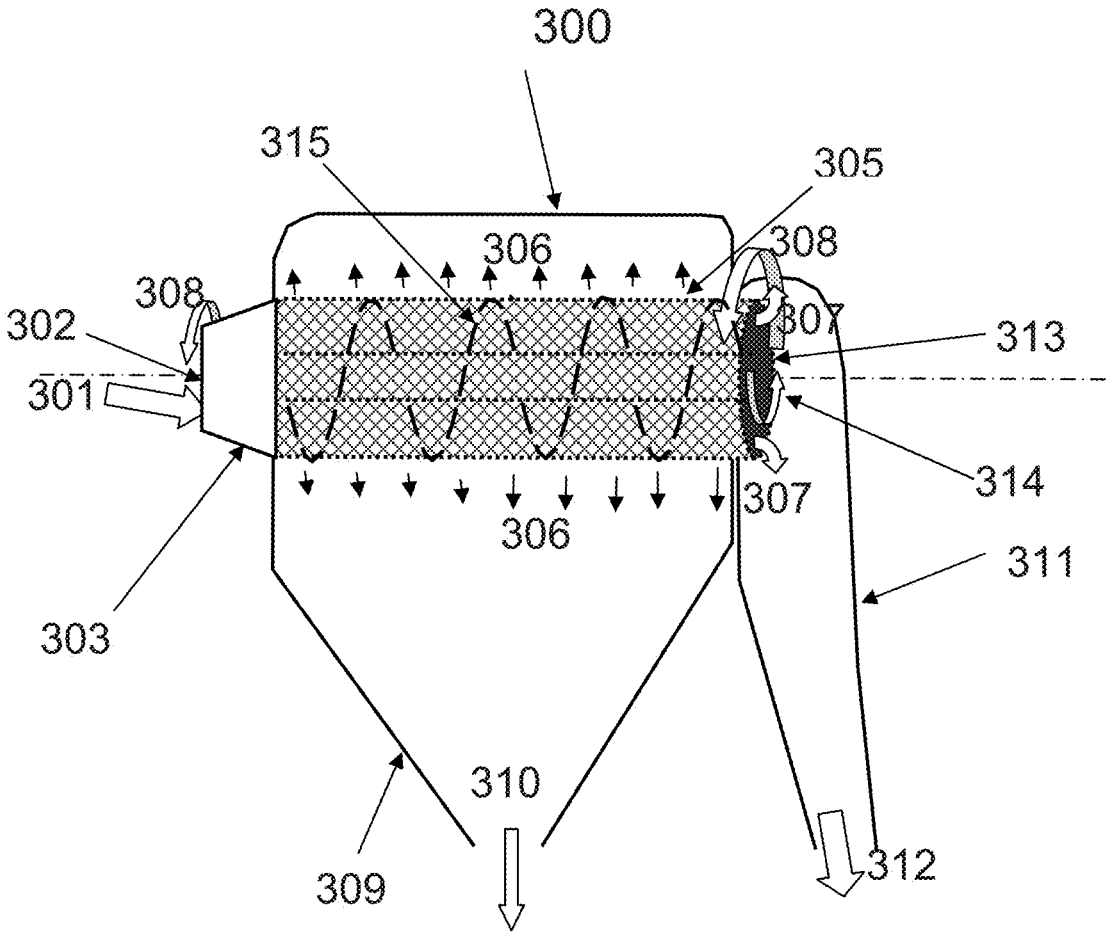
FIG. 3 is a schematic diagram of a centrifuging screen separator of the invention with a cylindrical screen, similar to the configuration of FIG. 2, except that the axial movement of the material along the inner rotating cylindrical screen is the result of a separately rotated helical screw (or helical brush).

As shown FIG. 3 a centrifuging screen separator 300 with a cylindrical screen 305 is similar to the separator 200 of FIG. 2, except that the axial movement of the material along the inner rotating cylindrical screen 305 is the result of a separately rotated helical screw (or helical brush) 315. In a preferred embodiment helical screw or brush 315 is rotating, as represented by arrow 314, somewhat faster than the cylindrical screen 305, whose rotation is represented by arrows 308. The helical screw/brush 315 acts in a manner similar to that described by Walton et al, 2011 (Apparatus and Method for Conveying Cohesive Materials, U.S. patent application Ser. No. 13/044,328 Publication number: US 2011/0220462 A1) and somewhat like a conventional screw conveyor and moves material axially along the inside wall of cylindrical screen 305. The apparatus could also function if the screw rotation 314 is somewhat slower than the rotation of the screen 308; however such an embodiment would require the 'hand' of the screw helix to be opposite of that for a faster rotating screw, and would make continuous feeding with the same screw as described in FIG. 4, difficult to accomplish. The fines 306 pass through the screen-wall 305, and the coarse material 307 which does not go through the screen is conveyed to the end 313 of the rotating cylinder 305 where it is collected in a shroud 311 to form a coarse-fraction outlet stream 312. The remaining parts of the separator 300 are similar to the corresponding parts of separator 200 in FIG. 2. Again, conventional mechanisms are used to mount and rotate the helical screw.

Figure 4A:
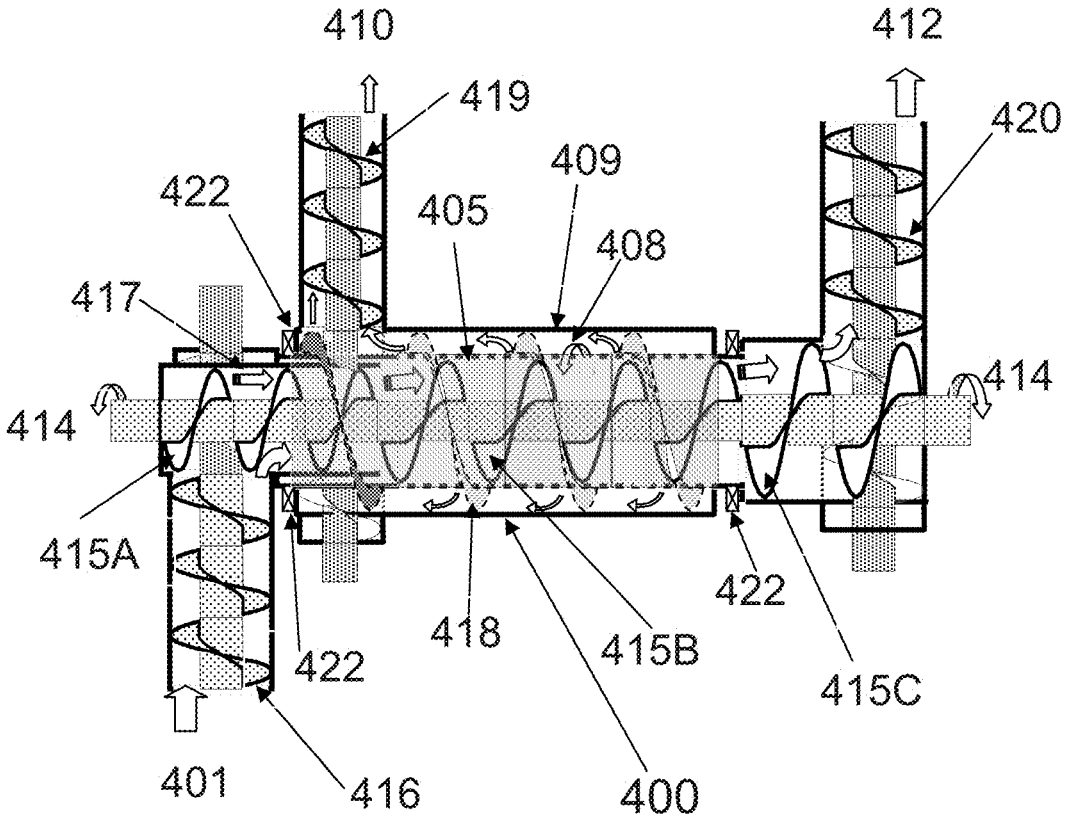
FIGS. 4A, B are schematic diagrams of a cylindrical centrifuging screen separator of the invention wherein all gravity-flow components have been replaced with screw-conveyors.
Figure 4B:
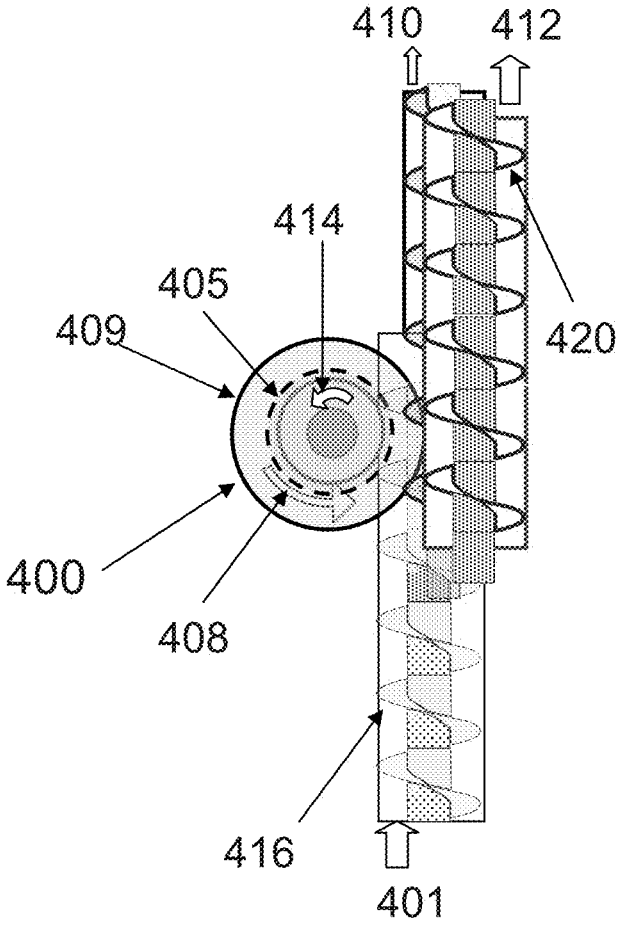

FIGS. 4A, B show side and end views of a cylindrical centrifuging screen separator 400 in which all gravity-flow components have been replaced with screw-conveyors that will function in any orientation with respect to gravity, or will function in true micro-gravity environments. Mixed-size feed stock 401 is conveyed to the centrifugal sieve through a screw conveyor 416, where it is transferred to another rapidly rotating screw conveyor 417 which carries the material into and through the rotating cylindrical screen 405. Helical screw 415, made up of adjacent sections 415 *a, b, c*, extends through conveyor 417, including cylindrical screen 405, rotates separately 414, and functions as helical screw 315 in conveyor 300 of FIG. 3. The diameters of the individual screw sections 415 *a, b, c* may be different. The outer walls surrounding screw sections 415 *a, c* are stationary, while the outer wall surrounding screw section 415 *b* is the rotating screen 405. The rotating screen 405 is supported by separate bearings 422 and has a separate drive mechanism than screw section 415 *b*, and rotates at a different speed 408. In this embodiment, the rotating cylindrical screen 405 has another helical brush conveyor-auger 418, with an opposite-hand helix, firmly attached on the outside wall of the cylindrical screen 405 and fitting within housing 409 which is formed as a concentric cylinder around screen 405. Housing 409 extends beyond both ends of screen 405 to form input and output ends thereof. This brush-helix auger 418 conveys the fine-fraction stream coming through the screen 405 back toward the input end (to the left-hand-end of the cylinder in FIG. 4A), while the coarse material continues axially inside the cylindrical screen 405 and comes out at the distal (on the right-hand in FIG. 4A) end. Both the fines stream and the coarse stream are transferred to output screw conveyors 419, 420 respectively from which they are output as outlet streams 410, 412 respectively. Conveyors 419, 420 may carry the separated material on to collection vessels, or to the next processing step. Conveyors 419, 420 could in some cases be replaced with simple collection shrouds as in FIGS. 1-3.

Figure 5A:
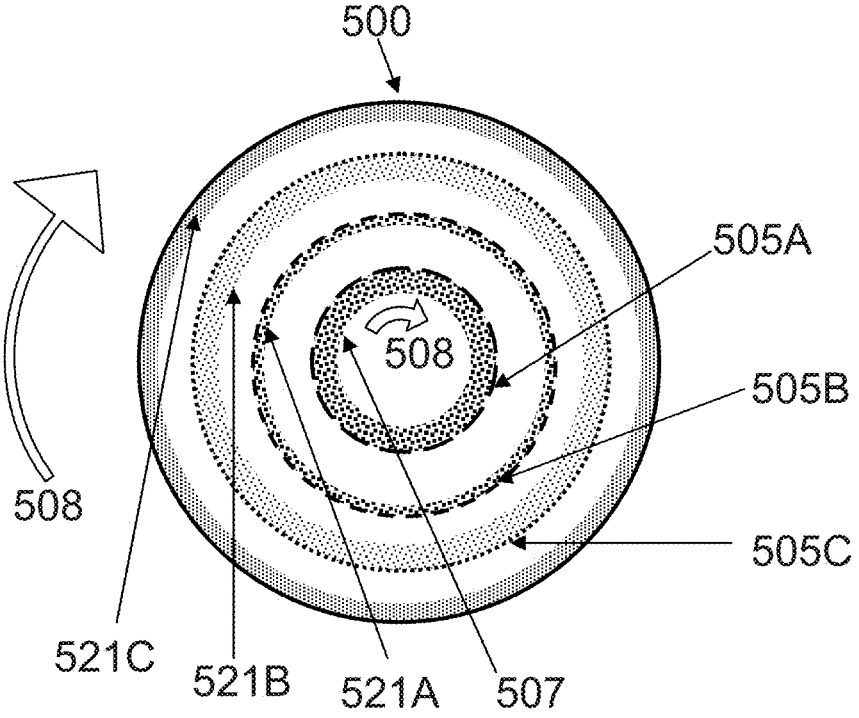
FIGS. 5A-C are schematic diagrams of cylindrical centrifuging sieves of the invention with multiple concentric screens.
Figure 5B:
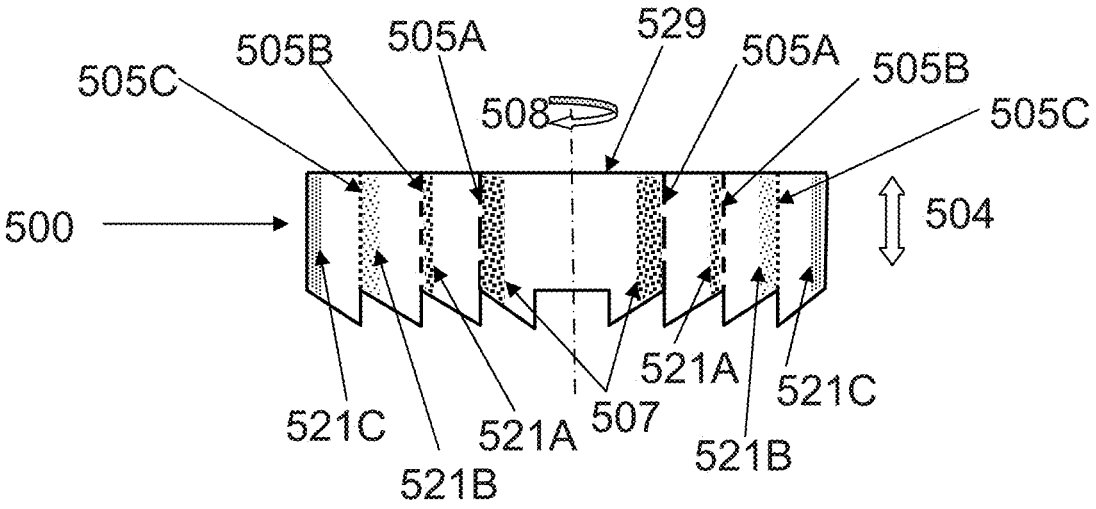
Figure 5C:
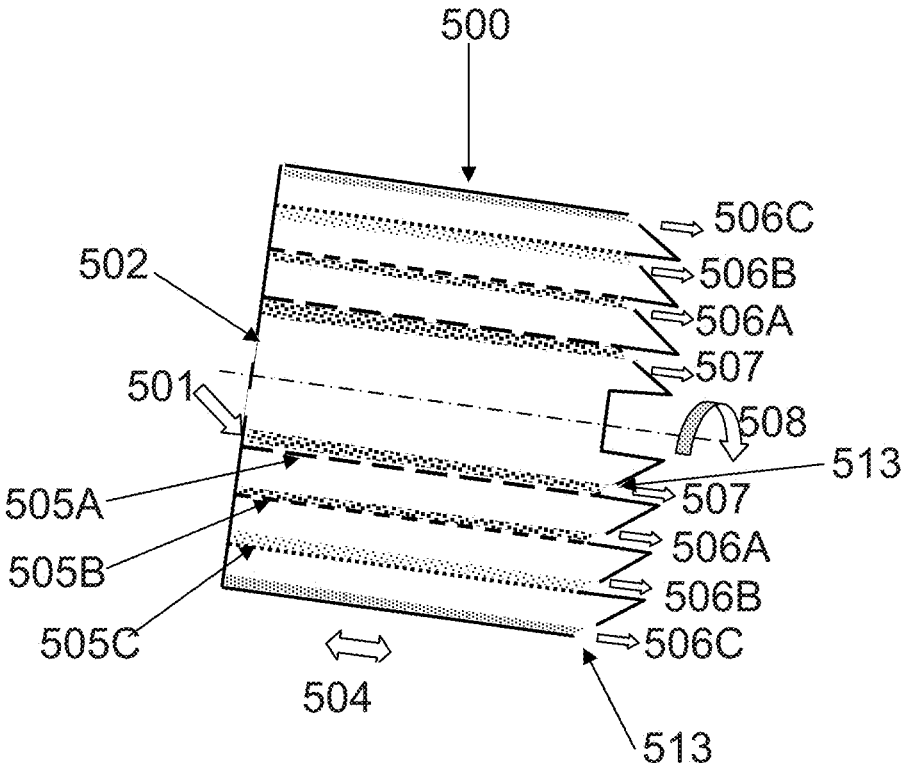

FIGS. 5A-C show a cylindrical centrifuging sieve 500 with multiple concentric screens 505 A, B, C, with each circumscribing screen being finer than the screen at a smaller radius. Multiple size fractions of the material 521 A, B, C are collected between the concentric screens 505 A, B, C. (While three concentric screens are shown, additional screens may be added.) FIG. 5B shows a vertical axis orientation, which would be the orientation for filling a batch size-distribution-measuring embodiment of the centrifuging sieve. In such an embodiment a removable lid 529 would be opened, and a batch of feedstock placed inside of the innermost screen. The set of screens could be rotated in this vertical axis orientation, or alternatively, once the lid is closed, the unit could be oriented with the axis horizontal, as shown in FIG. 5A, and rotated and vibrated as represented by arrows 508 and 504 respectively, until the various size fractions are separated into the concentric annular collection regions between the screens. After spinning, the unit could again be oriented with the axis vertical, and material removed from each annular collection ring. This removal could be facilitated by having sliding 'trap-doors' on the bottom of each annular collection ring, or alternatively, the material could be removed by opening the lid 529, and mechanically scooping material out of each annular collection ring. FIG. 5C shows a multiple concentric embodiment of the continuous-process tilted cylindrical configuration of FIG. 2. In this embodiment mixed feedstock material 501 is introduced at the upper end 502 of the cylindrical sieve, inside of the innermost cylindrical screen 505A. A coarse stream 507 and multiple fines-streams 506A, 506B, 506C, flow out the lower end 513 of the concentric cylindrical sieve configuration.

Thus, a batch processing embodiment of the centrifugal sieve as shown in FIGS. 5 A-B can be comprised of a set of concentric cylindrical screens of varying mesh size, ranging from coarse to fine as the radius increases. For use under any environment with a finite gravity (e.g. in other than in true micro-gravity conditions) a mixed-size feedstock material can be placed inside of the innermost cylindrical screen wall with a flat lid fitted over the entire concentric screen set (with seals at each screen) the unit can be rapidly rotated about its axis to effect separation. The rotation can be rapid enough to create centrifugal forces which hold the granular material against the outer screen wall (of each concentric annular region). The entire unit can be vibrated (in a manner analogous to typical batch stacked-screen sieves which are vibrated) to achieve size separation. After size-separation into each concentric annulus (between cylindrical screens), the separated material can be removed.

For continuous processing a variety of embodiments can be made which utilize the basic centrifugal sieve concept. The tested prototype utilized a rapidly rotating cylindrical screen with granular material transported axially along the inside surface of the screen via a compliant screw auger. The compliant auger was rotated somewhat faster than the screen to effect screw-conveying of the material along the screen-wall. The fine-fraction passed through the outer screen wall into a surrounding housing which captured the fines. The coarse fraction was transported axially completely through the cylindrical screen and out the other end, to a coarse-fraction collection hopper. One alternative embodiment without an auger would have the rotating cylinder tilted slightly in a gravity field and vibrated to allow gravity to provide axial displacement and the centrifugal force to cause sieving action. Another embodiment would utilize a rapidly rotating conical screen (preferably with a half-angle between 5 and 25 degrees) with granular feedstock introduced into the interior of the rotating conical frustum screen at the small end. Centrifugal force would hold the granular material on the rotating interior screen wall. Vibration of the unit would allow the material to flow axially along the wall, shearing and segregating as it flows. The fines would pass through the screen and the coarse material would move axially through and out the large end of the conical frustum. Another embodiment would use a tapered compliant auger inside of the conical screen frustum. Other configurations are possible, the unique feature of the invention is that centrifugal forces hold a granular material to be sieved against rotating circular screen(s), and shearing flow or vibration may assist the separation of the fines through the rotating screen(s).

Innovative features of the invention include a rotating outer (cylindrical or conical) screen wall, rotating fast enough for the centrifugal forces near the wall to hold granular material against the rotating screen. Conventional so-called 'centrifugal' sieves have a stationary screen and rapidly rotating blades that shear the granular solid near the stationary screen and effect the sieving process assisted by the air-flow inside the unit. The centrifugal sieves of this invention may (or may not) have an inner blade or blades, moving relative to the rotating wall screen. Some continuous flow embodiments would have no inner auger or blades, but achieve axial motion through vibration. In all cases the shearing action is gentler than conventional so-called centrifugal sieves which have very high velocity differences between the stationary outer screen and the rapidly rotating blades. The new design does not depend on air-flow in the sieving unit, so it will function just as well in vacuum as in air.

Utilizing centrifugal force as the primary body-force, combined with both shearing flow and vibratory motion the centrifugal-sieve separators of the invention can provide efficient gravity-level-independent size classification of granular feedstock like lunar regolith. The centrifugal size-separators of the invention utilize the natural size stratification of flowing granular solids. They will function equally well under reduced gravity conditions and in vacuum. The nominal design is a configuration with only one moving part and no blades, or other high-wear components. Shearing flow and vibrations combined with a size-separating screen at the outside (or 'bottom') of the flow will separate particles, with the fines passing through the outer wall screen, and the coarse material passing axially through the continuous feed system. Multiple size separation streams are possible. The centrifugal-sieve concept can be scaled to any desired mass flow rate.

Size classification is utilized throughout the mineral, chemical and pharmaceutical industries. Improved methods for separation, especially gentle methods suitable for friable materials, could have wide applications. Granular solids are an integral part of the multi-billion dollar fundamental chemicals and agriculture industries. In extraterrestrial exploration and other lunar or space utilization, reliable, robust separation methods that operate independent of gravity level would be useful for granular materials size separation for regolith processor feedstock conditioning. For example, the centrifugal-sieves of this invention could remove regolith particles >0.5 cm diameter before dumping the material into a storage bin during excavation operations for oxygen extraction. The centrifuging sieves of this invention could also be used for a degree of mineral beneficiation to separate particles by size and thus, increase the concentration of particular minerals which are more prevalent in certain size fractions of bulk regolith. These centrifugal-sieves can operate in low-gravity (⅙-g and ⅜-g) and micro-gravity as well as utilize multiple feedstock sources.

One advantage of the invention for batch sieving is that a batch-mode centrifugal sieve may accomplish the same sieving operation in much less time than a conventional stacked set of vibrated screens (which utilize gravity as the primary driving force for size separation).

An advantage of the continuous mode system is that it can be made with absolutely no gravity-flow components for feeding material into, or for extracting the separated size streams from, the centrifugal sieve. Thus the system is capable of functioning in a true micro-gravity environment as might exist on the surface of Phobos or other small extraterrestrial body. Another advantage of the continuous mode system is that some embodiments of the innovation have no internal blades or vanes, and thus, can be designed to handle a very wide range of feedstock sizes, including occasional very large oversize pieces, without jamming or seizing-up.

Prototype units have demonstrated separation of very coarse (i.e. greater than 5 mm) material from typical fine lunar regolith simulant material (JSC-1A simulant). Another prototype configuration (with a finer screen) was able to separate the component of JSC-1A below 0.1 mm in size from the portion that was larger than 0.1 mm. A reduced-gravity parabolic-flight capable prototype has been fabricated and plans have been made to test it under vacuum conditions and under reduced gravity conditions (in parabolic flight aircraft).

The centrifugal sieves might provide much faster batch processing of lab-scale quantities for size distribution analysis. Also, the mineral or primary materials industry may find the continuous centrifugal sieves to be more efficient or more compact than current technology for terrestrial operations. Almost any commercial utilization of space minerals would benefit from the use of size separation equipment like the centrifugal sieves of the invention.

In summary, the invention includes the following embodiments:

1) Rapidly rotating cylindrical screen (any orientation of axis) uses centrifugal force as the primary body-force driving size separation in a vibrated sieving embodiment (batch mode).

2) Rapidly rotated conical frustrum screen (any orientation of axis) uses centrifugal force as the primary body-force driving size separation in a continuous-mode vibrated sieving embodiment wherein mixed-size feedstock is introduced inside of the small end of the conical screen, the fine-fraction passes through the conical screen wall, and the coarse fraction exits out the large end of the conical frustrum screen.

3) Multiple concentric cylindrical screens, as in embodiment (1) above, can be used to produce a set of size-fractions of the original mixed-size material (batch mode).

4) Continuous-mode vibrated cylindrical sieve, as in either embodiments (1) or (3) above, with the axis of rotation tilted down a small angle from horizontal (usually less than 25-degrees, preferably between 10 and 15-degrees), and the mixed-size feedstock introduced on the inside of the upper end of the (innermost) rotating cylindrical screen, Fine material passes through the cylindrical screen wall(s) and the coarser material is retained inside of the screen and passes out the lower end of the cylindrical screen. With multiple concentric screens this embodiment can provide continuous size separation into multiple size-fractions.

5) Continuous-mode non-vibrated cylindrical sieve, similar to embodiment (1) above, uses a helical blade, drag-chain, or brush, rotating somewhat faster than the cylindrical screen (or somewhat slower with a helix of the opposite hand), to convey granular material axially along the rotating cylindrical screen wall. The conveyed material is separated into fines, passing through the outer screen wall, and coarse-material conveyed axially through the cylinder and out the opposite end.

6) Continuous-mode non-vibrated conical sieve, similar to embodiment (2) above, except uses a tapered helical blade, drag-chain, or brush, rotating somewhat faster than the conical frustrum screen (or somewhat slower with a helix of the opposite hand), to convey granular material axially along the rotating conical screen wall. The conveyed material is separated into fines, passing through the outer screen wall, and coarse-material is conveyed axially through the conical frustrum and out the opposite end.

7) Continuous-mode non-vibrated cylindrical sieve, similar to embodiment (5) above, but with a helical screw-blade, or helical coil-brush attached to the outside of the cylindrical screen to assist in collecting and conveying the fine-fraction which passes through the rotating screen. The exterior helical blade or brush could be wound with the opposite-hand of the helical conveying screw brush inside of the screen, so that the fines would be conveyed to one end and the coarse material conveyed to the opposite end of the cylindrical sieve screen.

8) A version of embodiment (7) wherein the inlet-feed stream is delivered by way of a screw-conveyor, and transferred in a sealed manner to the conveying screw/brush which takes material through the rotating screen, and the outlet streams of coarse and fine material are connected in a sealed manner to separate screw conveyors so that all volatile gases which might be released in the system are contained within the enclosing conveying pipes/tubes of the screw conveyors delivering material to and from the sieving unit. Such a configuration would have no gravity-flow components and could function in any orientation with respect to gravity, and would be suitable for use in true micro-gravity as occurs on the surfaces of asteroids, comets, and/or small moons of various solar system planets.

The various embodiments of the invention are based on and can include the following features:

Batch mode: A rapidly rotating cylindrical screen with mixed-size granular material placed inside is vibrated so that the fines pass through the outer screen wall where they are collected.

Continuous mode: A rapidly rotating conical screen has mixed-size granular material introduced inside of the small end, and is vibrated so that material flows along its inner wall. The fines pass through the screen wall where it is collected, and the coarse material travels axially out the large end of the cone.

The rapid rotation of the cylindrical or conical screen provides a body force, which can be controlled by the rotation rate, to facilitate the size separation of the fine material from the coarse material. This body force can be several times greater than the gravitational force acting on the material. Embodiments of this sieve can be constructed which have no gravity-flow elements (for introduction of material, or for collection of product) and thus are suitable for use in micro-gravity environments, such as on the surface of asteriods or other small solar-system bodies during space missions.

Conventional size segregation or screening in batch-mode, using stacked vibrated screens, is often a time consuming process. Utilization of centrifugal force instead of gravity as the primary body force in accordance with the present invention can significantly shorten the time to segregate feedstock into a set of different size fractions. Likewise, under reduced gravity, or microgravity, a centrifugal sieve system would function as well as it does terrestrially. When vibratory and mechanical blade sieving screens, designed for terrestrial conditions, were tested under lunar gravity conditions [Rame et al (2010) Zero-C Aug. 13-14, 2009 Flight Final Report] they did not function well. The centrifugal sieving design of the present invention overcomes the issues that prevented sieves designed for terrestrial conditions from functioning under reduced gravity.

In continuous-mode the centrifugal sieves of the invention can provide steady streams of fine and coarse material separated from a mixed feedstock flow-stream. A continouus process mode centrifugal sieve prototype was demonstrated as part of a NASA funded Small Business Inovation Research (SBR) project. Units with a similar design would be suitable for ISRU processing of regolith feedstock under Martian, Lunar, or other extraterrestrial body surface conditions. The centrigugal sieves can be scaled to any desired size and/or mass flow rate. Thus, they could be made in sizes suitable for small robotic exploratory extraterrestrial missions, or for semi-permanent processing of regolith for extraction of volatiles of minerals.

Other than two-phase (i.e., fluid-solid or gas-solid) cyclone separators, or hydrocyclones, almost all terrestrial size-separation processes utilize gravity flow of feedstock, and also for the movement of various size-fraction exit streams. True micro-gravity capable versions of continuous-mode centrigugal-sieves form a part of the present invention.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present dams. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

The invention claimed is:

1. An apparatus for size separation of a granular material, comprising:

a rotatable cylindrical or conical screen having an input end for receiving an input flow of both finer and coarser granular materials, and an outlet end for removing remainders of said coarser granular materials;

a drive mechanism able to rotate the screen at a speed that is sufficient to push said granular material out against the screen by centrifugal force to form a relatively uniform layer inside the entire circumference thereof;

a separately rotatable internal screw conveyor for moving and flowing said granular material axially within the screen that can promote material shearing such that the finer particles of said granular material are enabled to pass through the screen and the coarser particles are expelled from one end;

a cylindrical finer particles collection housing concentric to and surrounding the screen and extending beyond both said inlet and outlet ends of the screen and including itself input and output ends for the internal screw conveyor to carry said granular material into and through;

an input screw conveyor coupled to the input end of the housing;

a finer particles removing screw conveyor coupled to the cylindrical finer particles collection housing;

a finer particles moving helical auger blade or screw or brush attached to the outside of the screen and itself rotatable inside the cylindrical housing and for pushing any finer particles passed through the screen inside the finer particles collection housing to the finer particles removing screw conveyor; and a coarser particles removing screw conveyor coupled to the screen.

2. The apparatus of claim 1 wherein the finer particles removing screw conveyor is located nearest the input end of the screen.

* * * * *